United States Patent [19]

Oude Alink et al.

[11] 4,040,799

[45] Aug. 9, 1977

[54] CYCLOHEXLAMINES USED AS FUEL ADDITIVES

[75] Inventors: Bernardus A. Oude Alink, St. Louis; Neil E. S. Thompson, University City; Ronald P. Hutton, St. Louis, all of Mo.

[73] Assignee: Petrolite Corporation, St. Louis, Mo.

[21] Appl. No.: 512,424

[22] Filed: Oct. 7, 1974

[51] Int. Cl.[2] ..... C10L 1/22

[52] U.S. Cl. ..... 44/75

[58] Field of Search ..... 44/74, 73, 62, 75; 252/403

[56] References Cited

U.S. PATENT DOCUMENTS

| | | | |
|---|---|---|---|
| 2,009,480 | 7/1935 | Craig | 44/74 |
| 2,282,513 | 5/1942 | Downing et al. | 252/51.5 A |
| 2,509,891 | 5/1950 | Starr, Jr. et al. | 44/74 |
| 2,813,080 | 11/1957 | Bartlett | 44/73 |
| 3,034,876 | 5/1962 | Gee et al. | 44/73 |
| 3,186,810 | 6/1965 | Dunworth | 44/74 X |
| 3,227,532 | 1/1966 | Hitchcox | 44/62 |
| 3,304,260 | 2/1967 | Fields et al. | 44/62 |
| 3,355,490 | 11/1967 | VanMunster | 260/563 C |
| 3,490,882 | 1/1970 | Dunworth | 44/73 |
| 3,640,692 | 2/1972 | Rakow et al. | 44/63 |
| 3,701,641 | 10/1972 | Rakow et al. | 44/73 |

OTHER PUBLICATIONS

Schmidt et al., CA 76:140052n (1972).

*Primary Examiner*—Daniel E. Wyman
*Assistant Examiner*—Mrs. Y. Harris-Smith
*Attorney, Agent, or Firm*—Sidney B. Ring; Hyman F. Glass

[57] ABSTRACT

This invention relates to the reductive amination of unsaturated cyclic ketones; to cyclic amines prepared thereby; and to uses thereof. For example, when isophorone is reductively aminated, trimethyl cyclohexylamines and cyclohexenamines are obtained. This invention also relates to uses thereof, for example, as fuel additives, particularly for stabilizing distillate fuels.

6 Claims, No Drawings

CYCLOHEXLAMINES USED AS FUEL ADDITIVES

Certain unsaturated cyclic ketones are known, for example cyclohexyl ketones such as iosphorone.

Ser. No. 512,423 filed Oct. 7, 1974 (D-74-48) describes a facile method for the reductive amination of such unsaturated cyclic ketones which comprises reacting such unsaturated ketones with an amine in the presence of hydrogen so as to not only saturate the double bond but also to convert the ketone group to an amino group.

This is illustrated by the following reaction:

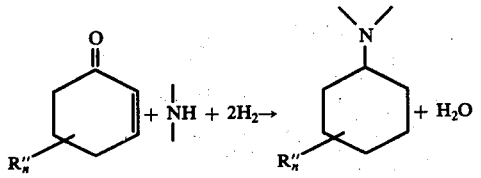

where R″ is hydrogen or a substituted group such as alkyl, etc. Any amine or substituted amine can be employed in the reductive amination provided it has a >NH group and the remaining groups of the amine do not interfere with the reductive amination.

The reaction is carried out in the presence of a hydrogenation catalyst such as palladium, platinum, nickel, etc.; at a suitable temperature, for example from ambient to 200° C. or higher, but preferably 50°–150° C.; at pressures sufficient to contain hydrogen in the reaction vessel, such as about 10–2000 psi, or higher but preferably about 200–1000 psi; for a sufficient period of time for the reaction to take place such as from about 10 minutes to 24 hrs. or longer, preferably from about ½ hr. to 6 hrs.; in solvents which do not interfere with the catalyst, reactants, or products such as water, alcohol, hydrocarbons, esters, etc.

This invention also includes mixtures of fully reduced cyclic amines and partially reduced amines, for example, mixtures of

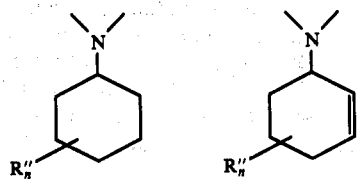

(I) (II)

in varying proportions such as from about 5–95% by weight of II, such as from about 15–85%, for example from about 25–75%, but preferably from about 30–50%.

Amine products more specifically included in this invention are

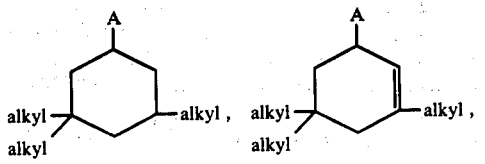

or combinations thereof, where A represents an amino group having no more than one hydrogen atom attached to the nitrogen atom.

The following examples are presented for purposes of illustration and not of limitation.

Representing the amine group, A, as defined above, by

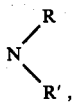

these examples are illustrative of compositions wherein R is hydrogen or methyl and R′ is alkyl, cyclohexyl, hydroxyalkyl and aminoalkyl.

EXAMPLE 1

N,N,-Dimethyl-3,5,5-trimethylcyclohexylamine

A mixture of 15.8g of dimethylamine, 32g of isophorone, 2g of 5% Palladium on charcoal and 150cc of ethanol was placed in an autoclave. Hydrogen gas was added to increase the pressure to 500 psi. The reaction mixture was heated to 95° C. and kept with stirring at 95° C. for 1 hr. Hydrogen gas was added during the reaction, to maintain a pressure of 330–500 psi. After the mixture was allowed to cool to ambient temperature, the solvent and the water produced were removed under diminished pressure. Distillation yielded 35g of N,N-dimethyl-3,5,5-trimethylcyclohexylamine; $b_{760}$ 196°–198° C; nuclear magnetic resonance spectrum, δ in ppm, 2.18 s, 6H; 2.15–1.00 *m*'s, 8H; 1.17 *s*, 3H; 0.90 *s* and 0.88 d, 6H.

Anal. Calced. for $C_{11}H_{23}N$ : N, 8.28, Found : N, 8.26.

EXAMPLE 2

N-Methyl-3,5,5-trimethylcyclohexylamine

A mixture of 108g (0.79M.) of isophorone, 150 cc of ethanol and 2g of 5% platinum on charcoal was placed in a 1 liter autoclave. The system was flushed 2 times with hydrogen gas. A sample of 24.5g (0.79M) of methylamine was added and hydrogen gas was introduced to raise the pressure to 500 psi. The reaction mixture was stirred and heated to 100° C. and kept at 100° C. for 34 minutes, while maintaining a pressure of 400–500 psi by occasional addition of hydrogen gas. The reaction mixture was allowed to cool to ambient temperature. The catalyst was removed by filtration and the solvent and water produced was removed by distillation under diminished pressure to yield 97g of a mixture of 20% N-methyl-3,5,5-trimethyl-2 cyclohexenamine and 80% of N-methyl-3,5,5-trimethylcyclohexylamine. $b_{760}$ 186°–188° C, nuclear magnetic resonance spectrum, δ in ppm.; 2.78 *m*, 1H; 2.32, *s*, 3H; 2.13–1.15 *m*'s, 7H; 1.10 *s*, 3H; 0.85 *s* and 0.87 *d*, 6H.

Anal. Calc.ed for $C_{10}H_{21}N$ ; N, 9.03, Found ; N, 9.00.

EXAMPLE 3

3,5,5-Trimethylcyclohexylamine

A mixture of 100g of isophorone (0.725M), 150 cc of ethanol and 10g of Raney nickel was placed in a 1 1. autoclave. The system was flushed 2 times with hydrogen gas and 25g of ammonia gas was added. The mixture was stirred and hydrogen gas was added to increase the pressure to 500 psi. The reaction mixture was heated for 1 hour at 120° C. while hydrogen gas was added to maintain a pressure 350–500 psi. The mixture was cooled to ambient temperature. The catalyst centrifuged off, and the solvent and water produced removed under diminished pressure to yield 87g of 3,5,5-trimethylcyclohexylamine, $b_{760}$ 176°–177° C.

Anal. Calc.ed for $C_9H_{19}N$ ; N, 9.93, Found ; N, 9.81.

As described in example 1, several amines were reacted with isophorone under reductive conditions. The results are summarized in Table I.

TABLE I

| Ex. No. | Catalyst | g. of catalyst | Amine | g. of amine | g. of Isophorone | Reaction Pressure psi | Reaction temp. °C | Reaction time hrs | Product Formed |
|---|---|---|---|---|---|---|---|---|---|
| 4 | 5% Pt/C | 2 | Methyl amine | 52 | 100 | 400–500 | 100 | 1 | 57% N-methyl-3,5,5-trimethylcyclohexylamine; 43% N-methyl-3,5,5-trimethylcyclohexen-2-amine |
| 5 | 5% Pt/C | 2 | Methyl amine | 26 | 110 | 350–500 | 100 | 3½ | 85% N-methyl-3,5,5-trimethylcyclohexylamine; 15% N-methyl-3,5,5-trimethyl cyclohexen-2 amine |
| 6 | 5% Pd/C | 2 | Methyl amine | 26 | 57 | 330–500 | 95 | 1 | 100% N-methyl-3,5,5-trimethylcyclohexylamine |
| 7 | Raney Ni | 10 | Methyl amine | 34 | 75 | 400–560 | 120 | 1 | 91% N-methyl-3,5,5-trimethylcyclohexylamine; 9% 3,5,5-trimethylcyclohexanol |
| 8 | 5% Pt/C | 2 | Dimethyl amine | 27 | 75 | 400–500 | 120 | 6 | 60% N,N-dimethyl-3,5,5-trimethylcyclohexylamine; 40% N,N-dimethyl-3,5,5-trimethylcyclohexen-2 amine |
| 9 | Raney Ni | 10 | Dimethyl amine | 27 | 75 | 400–500 | 125 | 2.5 | 60% N,N-dimethyl-3,5,5-trimethylcyclohexylamine; 3,5,5-trimethyl cyclohexanol |
| 10 | 5% Pt/C | 2 | Cyclohexyl amine | 53.5 | 75 | 450–500 | 100 | 4 | 80% N-Cyclohexyl-3,5,5-trimethylcyclohexylamine; 20% N-Cyclohexyl-3,5,5-trimethylcyclohexen-2 amine |
| 11 | 5% Pt/C | 2 | Ethylene diamine | 33 | 75 | 400–500 | 110 | 4 | 42% N-(3,5,5-trimethylcyclohexyl) ethylenediamine; 58% N-(3,5,5-trimethylcyclohexen-2) ethylenediamine |
| 12 | 5% Pt/C | 3 | Monoethanol amine | 61 | 138 | 450–580 | 95 | 3 | 100% N-(3,5,5-trimethylcyclohexyl-ethanolamine |

The following series of mixtures were also prepared by less than complete reduction to yield the following mixtures:

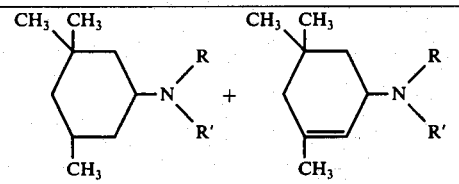

Compound I Compound II

| Ex. | | |
|---|---|---|
| A | R=H, R'=$CH_3$; | 43% by weight of compound II |
| B | R=H, R'=$CH_3$; | 25% by weight of compound II |
| C | R=H, R'=$CH_3$; | 11% by weight of compound II |
| D | R=H, R'=$CH_3$; | 0% by weight of compound II |
| E | R,R'=$CH_3$ | 40% by weight of compound II |
| F | R,R'=$CH_3$ | 0% by weight of compound II |

The compositions of this invention are useful as fuel additives.

In addition to their uses as fuel additives, the compositions of this invention may be employed as corrosion inhibitors, biocides, (i.e., bactericide, algicides, etc.) as well as other uses.

USE AS FUEL ADDITIVE

As is well known, fuel oils have a tendency to deteriorate in storage and form soluble colored bodies and insoluble sludge therein. This deterioration of the oil is highly undesirable in that it causes serious adverse effects on the characteristics of the oil, particularly on the ignition and burning qualities thereof. It is also a contributory factor, along with the presence of other impurities in the oil, such as rust, dirt and moisture, in causing clogging of the equipment parts, such as screens, filters, nozzles, etc., as is explained further herein. An important economical factor is also involved in the problem of oil deterioration in storage, viz., customer resistance. Thus, customers judge the quality of an oil by its color and they oftentimes refuse to purchase highly colored oils. It will be appreciated then that since fuel oils of necessity are generally subject to considerable periods of storage prior to use, the provision of a practical means for preventing the deterioration of the fuel oil during storage would be a highly desirable and important contribution to the art.

The problem of the formation of color bodies and sludge is further aggravated because fuels, such as diesel and jet fuels, are often preheated for some time before consumption, thus introducing the additional problem of thermal instability.

We have now found that oil deterioration, with attendant formation of color and sludge in the oil, can be inhibited by employing the additives of this invention in the oil. In general, one employs a minor amount of the additives which is sufficient to inhibit oil deterioration with the attendant formation of color and sludge. Preferred additives are those wherein the amino group has no more than one hydrogen atom attached to the nitrogen atom.

The amount of additive employed will vary depending on various factors, for example the particular oil to be stabilized, the conditions of storage, etc. The stability of an oil depends largely on the nature of the crude oil from which it is made, the type of processing involved during refining, etc., and therefore some oils will require more additives to stabilize them than others. For example, caustic-treated oil will, in general, require less additive than untreated oil of similar character. In practice, one generally employs at least about 0.0001% (1 p.p.m.), such as from about 0.0001 to 0.1% (1–1000 p.p.m.), for example about 0.0002 to 0.05% (2–500 p.p.m.), but preferably about 0.0003 to 0.03% (3–300 p.p.m.) based on weight of oil. Larger amounts, such as 1% or higher, can be employed but in general there is usually no commercial advantage in doing so.

Fuel oils in general are contemplated by the invention. The fuel oils with which the invention is especially concerned are hydrocarbon fractions having an initial boiling point of at least about 100° F. and an end point not higher than about 750° F., and boiling substantially continuously throughout their distillation range. Such fuel oils are generally known as distillate fuel oils. It will be understood, however, that this term is not restricted to straight-run distillate fractions. Thus, as is well known to those skilled in the art, the distillate fuel oils can be straight-run distillate fuel oils, catalytically or thermally cracked (including hydrocracked) distillate fuel oils, or mixtures of straight-run distillates, naphthas and the like, with cracked distillate stocks. Moreover, such fuel oils can be treated in accordance with well known commercial methods, such as acid or caustic treatment, solvent refining, clay treatment, etc.

The distillate fuel oils are characterized by their relatively low viscosities, low pour points, and the like. The principal property which characterizes the contemplated hydrocarbon fractions, however, is the distillation range. As mentioned herein, this range will lie between about 100° F. and about 750° F. Obviously, the distillation range of each individual fuel oil will cover a narrower range falling, nevertheless, within the above-specified limits. Likewise, each fuel oil will boil substantially continuously throughout its distillation range.

Especially contemplated herein are Nos. 1, 2 and 3 fuel oils used in domestic heating and as diesel fuel oils, particularly those made up chiefly or entirely of cracked distillate stocks. The domestic heating oils generally conform to the specifications set forth in A.S.T.M. Specifications D396-48T. Specifications for diesel fuels are defined in A.S.T.M. Specifications D975-48T. Also contemplated herein are fuels for jet combustion engines. Typical jet fuels are defined in Military Specification MIL-F-5624B.

The following diesel fuel test is a standard test for diesel fuel stability and is regarded as a rapid screening test for discovering new systems, which can be used to stabilize petroleum distillate fuels.

DIESEL FUEL TEST 90 minutes at 300° F.

In the operation of a diesel engine, a portion of the fuel sent to the fuel injection system is injected and burned; the remainder is circulated back to the fuel reservoir. The injection system is located on the engine such that the fuel being returned to the reservoir is subjected to high temperatures. Consequently, diesel fuels should exhibit good thermal stability as well as good storage stability. Since the fuels used as diesel fuel are interchangeable with furnace oils, the following procedure is used to screen the thermal stability of fuel oils in general.

The test involves exposing 50 ml. samples of fuel, containing desired quantities of fuel additives, to the test where a bath is held at 300° F. and the samples are exposed for 90 minutes.

After cooling to room temperature the exposed fuel is passed through a moderately retentive filter paper and the degree of stain on the filter paper noted. The filter paper pads are compared according to a rating of 5, 4, 3, 2 or 1, where 5 = worst and 1 = best.

The following additives were employed in the test:

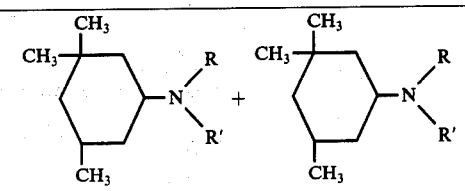

Compound I Compound II

| Additive | |
|---|---|
| A | R=H, R′= —$CH_3$; 43% of Compound II |
| B | R=H, R′= —$CH_3$; 25% of Compound II |
| C | R=H, R′= —$CH_3$; 16% of Compound II |
| D | R=H, R′= —$CH_3$; 0% of Compound II |
| E | R, R′= —$CH_3$; 49% of Compound II |
| F | R, R′= —$CH_3$; 0% of Compound II |

90 min. 300° F. Thermal Stability Test
Whatman No. 1 filters
(Ratings are comparative; 1 = best)

| Additive | Fuel and Additive conc. 1 at 20 ppm | 2 at 20 ppm | 3 at 40 ppm | 4 at 40 ppm | Totals |
|---|---|---|---|---|---|
| None | 5 | 5 | 5 | 5 | 20 |
| N-methylcyclohexylamine | 2 | 2 | 3 | 2 | 9 |
| N,N-dimethylcyclohexylamine | 1 | 2 | 2 | 2 | 7 |
| Additive A | 2 | 2 | 2 | 2 | 8 |
| Additive B | 2 | 1 | 2 | 2 | 7 |
| Additive C | 3 | 2 | 2 | 2 | 9 |
| Additive D | 3 | 2 | 2 | 2 | 9 |
| Additive E | 2 | 1 | 2 | 1 | 6 |
| Additive F | 2 | 2 | 1 | 2 | 7 |

Fuels are No. 2 mid-distillate.
Fuels Nos. 1, 2, and 4 are mid-continent U.S.
Fuel No. 3 is Canadian

110° F. OVEN STORAGE TEST

The 110° F. Oven Storage Test is considered to be one of the most reliable means of evaluating the storage stability of fuel oils. Generally speaking, one week in storage in this test is equivalent to one month field storage for most fuels.

400 ml. of filtered fuel containing the desired concentration of stability additive is placed into a vented glass jar. The containers are then placed in storage which is maintained for 20 hours at 110° F., followed by a 4 hour period at 95° F. This cycling procedure is continued to promote breathing.

After a desired period of time, depending upon the length of field storage, the samples are removed.

Immediately after removal, the samples are evaluated for color prior to filtration.

Following color evaluation, residue from the fuel is collected by filtration using a sintered glass filter having a 4 to 8 micron porosity. The storage container and the residue are then washed with n-heptane to remove any remaining fuel.

Gum Solvent (50% acetone — 50% methanol) is then used to wash the residue from the filter and the storage container into a tared beaker. The solvent is then evaporated and the beaker weighed. Residue is determined by weight difference.

110° F. Oven Storage Test
4 weeks storage
Fuel: Mid-continent No. 2 fuel oil

| Additive | Conc. | Residue (Mg/100 ml) |
|---|---|---|
| None | — | 2.9 |
| N-Methylcyclohexylamine | 60 ppm | 2.0 |
| N,N-dimethylcyclohexylamine | 60 ppm | 2.3 |
| Additive A | 60 ppm | 1.8 |
| Additive B | 60 ppm | 1.8 |
| Additive C | 60 ppm | 1.7 |

-continued

| Additive | 110° F. Oven Storage Test 4 weeks storage Fuel: Mid-continent No. 2 fuel oil Conc. | Residue (Mg/100 ml) |
|---|---|---|
| Additive D | 60 ppm | 1.8 |
| Additive E | 60 ppm | 2.0 |
| Additive F | 60 ppm | 2.0 |

Although the additives of this invention are useful as fuel additives per se their performance may be enhanced by employing certain auxiliary chemical aids. Among these chemical aids are dispersants, for example acrylic polymers or copolymers which can be employed in conjunction with the cyclohexylamines.

One such auxiliary chemical component is the copolymer derived from an acrylic ester of the formula:

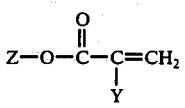

and N-vinyl-2-pyrrolidone, for example, a copolymer containing the following units:

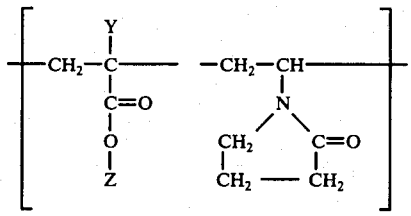

having a molecular weight for example of at least 50,000, for example 50,000–500,000, or higher, but preferably 100,000–400,000 with an optimum of 300,000–400,000 of which vinyl pyrrolidone comprises at least 1% by weight, of the polymer, for example 1–30%, but preferably 3–15% with an optimum of 5–10%; where Y is hydrogen, a lower alkyl group such as methyl, ethyl, etc., Z is an hydrocarbon group having, for example, 1–30 carbon atoms, but preferably 8 to 18 carbon atoms. These polymers are preferably acrylic or methacrylic polymers, or polymers derived from both in conjunction with vinyl pyrrolidone. The Z group on the polymer, which can be the same throughout or mixed, can be octyl, nonyl, decyl, undecyl, dodecyl, tridecyl, tetradecyl, pentadecyl, octadecyl, etc. Lower alkyl groups can also be employed such as methyl, ethyl, propyl, butyl, pentyl, hexyl, heptyl, etc., but they preferably are employed as copolymers of the higher Z groups, for example a copolymer of dodecyl methacrylate and methyl acrylate, etc. The acrylic ester units may be derived from one or more acrylic type monomers and may be fully acrylic or fully methacrylic or both acrylic and methacrylic. The polymer may be random, block, graft, etc.

Also, Z may also be an alkylated aromatic group such as butyl phenyl, amyl phenyl, etc., or a cycloaliphatic group such as cyclohexyl. Thus, non-limiting specific examples of suitable monomeric esters are: methyl acrylate, ethyl acrylate, propyl methacrylate, amyl acrylate, lauryl acrylate, cetyl acrylate, octadecyl acrylate, amyl methacrylate, lauryl methacrylate, cetyl methacrylate, octadecyl methacrylate, amylphenyl methacrylate, cyclohexyl methactylate, etc., including the analogous acrylate or methacrylate esters. Copolymers of the above and other acrylic esters may be used, for example, a copolymer of methyl or ethyl acrylate and dodecyl methacrylate in conjunction with vinyl pyrrolidone. However, it should be understood that this description does not preclude the presence of small amounts of unesterified groups being present in the polymer, i.e., approximately 5% or less of where Z=H.

It should be understood, or course, that when the above compounds are polymerized, the polymerization should not be carried to such an extent as to form polymers which are insoluble or non-dispersible in the petroleum hydrocarbon used. The polymerization may be carried out by methods known to the art, such as by heating mildly in the presence of a small amount of benzoyl peroxide, but the method of polymerization is not part of this invention. For examples of acrylic-vinyl pyrrolidone copolymers see French Pat. No. 1,163,033.

Examples of vinyl pyrrolidone-acrylic ester type resins are presented in the following table:

VINYL PYRROLIDONE-ACRYLIC ESTER TYPE RESINS

| Ex. | Monomer 1 | Monomer 2 | Monomer 3 | Vinyl pyrrolidone, percent by wt. | Mol ratio 1:2:3 | Av. mol weight |
|---|---|---|---|---|---|---|
| 1 | Tridecyl methacrylate | Octadecyl methacrylate | | 7.5 | 1:1 | 300,000 |
| 2 | Dodecyl methacrylate | | | 10 | | |
| 3 | Dodecyl methacrylate | Butyl acrylate | | 15 | 2:1 | 400,000 |
| 4 | Octadecyl methacrylate | | | 5 | | 450,000 |
| 5 | Tridecyl methacrylate | | | 20 | | 350,000 |
| 6 | Octadecyl methacrylate | Methyl methacrylate | | 10 | 3:1 | 500,000 |
| 7 | Dodecyl methacrylate | Ethyl acrylate | | 5 | 4:1 | 400,000 |
| 8 | Cetyl methacrylate | Octadecyl methacrylate | Butyl methacrylate | 7.5 | 2.1:0.5 | 350,000 |

Another auxiliary chemical component is a metal deactivator for example those conveniently employed in deactivating copper, iron and other metals from hydrocarbon systems. Typical examples are those described in U.S. Pat. No. 2,282,513. Of course, one skilled in the art is aware that many other metal deactivators are known and can be employed.

The compounds employed as metal deactivators are preferably of the type of Schiff bases and may be represented by the formulae $$A - CH = N - R - N = CH - B \quad (1)$$

and preferably, $$HO - A - CH = N - R - N = CH - B - OH \quad (2)$$

wherein A and B each represents an organic radical and preferably a hydrocarbon radical. In Formula 2 A and B each preferably represents an aromatic ring or an unsaturated heterocyclic ring in which the hydroxyl radical is attached directly to a ring carbon atom ortho to the — CH = N-group. R represents an aliphatic radical having the two N atoms attached directly to different carbon atoms of the same open chain.

Typical examples of aldehyde and polyamines employed in preparing these Schiff bases include the following:

ALDEHYDES

Benzaldehyde
2-methylbenzaldehyde
3-methylbenzaldehyde
4-methylbenzaldehyde
2-methoxybenzaldehyde
4-methoxybenzaldehyde
2-naphthaldehyde
1-naphthaldehyde
4-phenylbenzaldehyde
Propionaldehyde
n-Butyraldehyde
Heptaldehyde
Aldol
2-hydroxybenzaldehyde
2-hydroxy-6-methylbenzaldehyde
2-hydroxy-3-methoxybenzaldehyde
2-4-dihydroxybenzaldehyde
2-6-dihydroxybenzaldehyde
2-hydroxynaphthaldehyde-1
1-hydroxynaphthaldehyde-2
Anthrol-2-aldehyde-1
2-hydroxyfluorene-aldehyde-1
4-hydroxydiphenyl-aldehyde-3
3-hydroxyphenanthrene-aldehyde-4
1-3-dihydroxy-2-4-dialdehyde-benzene
2-hydroxy-5-chlorobenzaldehyde
2-hydroxy-3-5-dibromobenzaldehyde
2-hydroxy-3-nitrobenzaldehyde
2-hydroxy-3-cyanobenzaldehyde
2-hydroxy-3-carboxybenzaldehyde
4-hydroxypridine-aldehyde-3
4-hydroxyquinoline-aldehyde-3
7-hydroxyquinoline-aldehyde-8

POLYAMINES

Ethylenediamine
1-2-propylenediamine
1-3-propylenediamine
1-6-hexamethylenediamine
1-10-decamethylenediamine
Diethylenetriamine
Triethylenetetramine
Pentaerythrityltetramine
1-2-diaminocyclohexane
Di-(b-aminoethyl)ether
Di-(b-aminoethyl)sulfide The ratio of the additives of this invention to the metal deactivator can vary widely depending on the particular system, the fuel, etc. employed. Thus, the weight ratio of additive to metal deactivator may be from about 0.1 to 20 or more, such as from about 8–15, but preferably from about 10–12.

The weight ratio of additive to the acrylic type polymer can also vary widely from about 0.1–20 or more, such as from 8–15, but preferably from about 10–12.

For ease of handling a concentrate of the additive of this invention in a solvent such as a hydrocarbon, for example in concentrations of 5–75% or higher, such as from 20–60, but preferably from 40–60%.

The additives of this invention may also be used in petroleum products to inhibit the formation of deposits on metal surfaces such as occurs in tubes, evaporators, heat exchangers, distillation and cracking equipment and the like.

We claim:

1. A distillate fuel oil containing a stabilizing amount of a compound of the formula

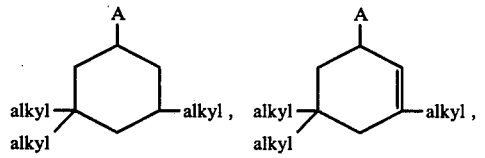

or combinations thereof, where A represents an amino group having no more than one hydrogen atom attached to the nitrogen atom, with the remaining groups of the amine not interfering with reductive amination.

2. The composition of claim 1 where the alkyl groups are methyl.

3. The compositions of claim 2 where A is

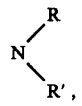

R being hydrogen or methyl and R′ being alkyl, cyclohexyl, hydroxyalkyl or aminoalkyl.

4. The composition of claim 3 where R′ is methyl.

5. The composition of claim 3 where R and R′ are methyl.

6. The composition of claim 3 where R is hydrogen.

* * * * *